United States Patent [19]

Orofino

[11] 4,210,351

[45] * Jul. 1, 1980

[54] SANITARY PICKUP DEVICE FOR ANIMAL FECES

[76] Inventor: Michael J. Orofino, 2 Brookside Dr., Baldwin, N.Y. 11510

[ * ] Notice: The portion of the term of this patent subsequent to Jun. 27, 1995, has been disclaimed.

[21] Appl. No.: 943,718

[22] Filed: Sep. 19, 1978

[51] Int. Cl.[2] ..... A01K 29/00

[52] U.S. Cl. ..... 294/1 BB; 294/1 BA

[58] Field of Search ..... 294/1 R, 19 R, 20, 22, 294/50.7, 50.8, 55, 115; 15/104.8, 257.1, 257.6, 257.7; 56/334, 336; 119/1

[56] References Cited

U.S. PATENT DOCUMENTS

| | | | |
|---|---|---|---|
| 637,908 | 11/1899 | Vroman | 15/257.1 |
| 1,038,924 | 9/1912 | Matthews | 294/50.7 |
| 2,526,340 | 10/1950 | Felsing | 294/115 X |
| 3,328,066 | 6/1967 | Johnston | 294/115 X |
| 3,668,848 | 6/1972 | Gerkin | 56/334 |
| 4,010,970 | 3/1977 | Campbell | 294/19 R |
| 4,097,082 | 6/1978 | Orofino | 294/19 R |

*Primary Examiner*—Johnny D. Cherry

*Attorney, Agent, or Firm*—Shoemaker and Mattare, Ltd.

[57] ABSTRACT

A device for picking up animal droppings in a variety of ways, all of which do so in a completely sanitary manner. The device has a pair of spaced pickup plates which are curved at the lower edges thereof and a hinge mechanism which is mounted on the plates to be out of the way so that a flexible wrapper can be securely held and loaded from either above or below so that the wrapper can be used to either pick up or catch debris and enclose that debris in a completely sanitary manner without requiring excessive contact of either the wrapper or any part of the device which may contact that debris. The wrapper is doubled back over the elements of the device which effect the pickup motion to protect those elements from contact with the droppings. After the pickup has been completed, the wrapper can be securely closed, and the securely closed wrapper is transported in the device to a suitable depository.

12 Claims, 10 Drawing Figures

SANITARY PICKUP DEVICE FOR ANIMAL FECES

BACKGROUND OF THE INVENTION

The present invention relates in general to article pickup devices, and, more particularly, to devices for the sanitary pickup of animal feces.

Many municipalities have laws and ordinances requiring animal owners to remove the feces left by their animals from public and private property. Furthermore, animal owners often desire to pick up animal droppings from an area wherein the animal is confined. Such removal requires the animal owner to pick up the feces and transport it to a suitable depository.

It is desirable to accomplish the pickup task in a sanitary manner so that the owner is not required to contact either the feces itself or any element of a pickup device which contacts that feces. It is also desirable to permit disposal of the feces in a securely wrapped manner.

There are many devices which permit one to pick up such feces and transfer that picked-up feces into a wrapper. However, all of these known devices have a similar deficiency, in that the wrapper used to contain the feces must be closed by hand, thereby requiring the user to come into contact with the wrapper. Any time one contacts an element which itself contacts the feces, the sanitary nature of the device is contravened.

There are also devices known which permit orientation of a bag below an animal to receive droppings therein. See, for example, U.S. Pat. No. 4,010,970 issued to J. R. Campbell. However, the device disclosed in the Campbell patent requires a special bag which is closed by hand. Both of these requirements are undesirable, and the latter requirement is unsanitary.

None of the presently known devices are both completely sanitary and amenable to use in a variety of manners, that is, for both pickup and/or catching debris. Catching debris may be important in certain situations, such as in a training environment or the like; however, if for some reason catching is missed, it is inconvenient to change devices to execute a pickup. Such change of devices may cause loss of time and be expensive. Accordingly, there is need of a single sanitary pickup device which can be operated in at least two modes, one mode being a pickup mode and the other being a catching mode wherein the device is operated in a manner which catches debris before that debris reaches the ground. There are devices which can operate both as a pickup and a catching device, but these devices, such as the device disclosed in U.S. Pat. No. 3,937,509, are not completely sanitary as part of either the wrapper or the device itself near the feces contacting areas thereof must be contacted by a user for disposing the filled wrapper. Such contact is not sanitary and is quite undesirable.

Further devices used to pick up animal feces are disclosed in U.S. Pat. Nos. 3,703,158 (which requires a user to contact the wrapper after use and is, therefore, quite unsanitary, and cannot be used in dual modes); 3,868,135 (having a hinge which may be contacted by feces and hence is undesirable); 3,984,139 and 3,606,436 (which do not permit removal of a wrapper in a completely sanitary manner).

The device embodying the teachings of the present invention enables one to pick up, wrap and transport articles such as animal droppings without contacting either the droppings or any element of the device which itself contacts the droppings, and further permits catching such droppings before such debris reaches the ground.

SUMMARY OF THE INVENTION

The device embodying the teachings of the present invention enables one to either pick up or catch articles such as animal droppings in a completely sanitary manner.

The device embodying the teachings of the present invention includes a pair of blades pivotally mounted on a frame so that the bottom edges thereof can contact the ground. A hinge is mounted on the top of the blades to be located on one side of those blades, thereby providing free access to the area between the blades from either the top or the bottom of the blades. The hinge is connected to an operating rod which is controlled by a hand-operated trigger mechanism. A control handle is used to open and close the blades, and a spring biases the plates into an open position, and is at rest when the plates are in the open position. Opening the hinge causes the blades to tilt with respect to each other so that the bottom edges thereof are moved toward each other along an arc to effect a scraping movement which is directed inwardly of the device.

An elastomeric-like band, such as a rubber band, can be positioned about the blades adjacent the bottom edges thereof. When the blades move through the arcuate path on the pickup stroke, the band abuts a top section of notches defined in the blades and is prevented from remaining on those blades. The band thus moves off of the blades. The bottom edges of the blades may have rounded edges to allow the band to readily move off of the blades.

A flexible wrapper is positioned between the pickup blades and has an open mouth which is located either between the blade lower edges or between the blade upper edges. The wrapper is doubled back over the blade edges so that when the blades execute the closing, or pickup, motion, the wrapper inside surface contacts the feces and the wrapper thus protects the pickup device from contact with that feces. When the wrapper mouth is located between the blade upper edges, the mouth is open upwardly to catch debris before such debris reaches the ground, and when the wrapper mouth is located between the lower blade edges, the device can be used as a pickup device. The device is thus quite versatile.

When used, the band snaps over the wrapper and closes same after the pickup is completed. The wrapper is thus securely closed and the user never need contact any element of the pickup device or wrapper which contact the feces, and therefore use of the pickup device is entirely sanitary.

Because the device embodying the teachings of the present invention enables the wrapper to be automatically and securely closed, the operator is not required to hold or touch any element which may have contacted the excretement. As no part of the device contacts the excretement, the device is maintained in a sanitary condition and can thus be used, repaired and stored without any of the problems which are incident to an unsanitary device.

The device can be operated using only one hand, thereby freeing the user's other hand to hold a leash, or the like. Because of the action of the operating rod, the user need not kneel, bend or stoop in order to gather the droppings together and pick up such droppings.

Once picked up, the droppings are securely held within a securely closed wrapper due to the action of both the spring loaded operating rod and the elastomeric-like band which, when used, is securely wrapped about the mouth of the wrapper. Furthermore, the device can be carried without having any of the contents exposed.

Once a suitable disposal position is reached, the device can be opened to deposit a securely closed wrapper therein without requiring the operator to contact the wrapper or any other element which may have contacted the excretement at some time.

The device can be manufactured in various sizes to accommodate animals of various sizes.

Because the hinge is located out of the way, the device can be operated to clean an entire area by picking up droppings and tilting the device to move the droppings into the bag, or the device can be operated in a manner similar to the device disclosed in U.S. Pat. No. 4,097,082, issued to M. J. Orofino, and the disclosure of this patent is fully incorporated herein by reference thereto.

OBJECTS OF THE INVENTION

It is, therefore, a main object of the present invention to provide a versatile pickup device which is entirely sanitary.

It is another object of the present invention to provide a versatile pickup device which permits droppings to be either picked up or caught before reaching the ground in a completely sanitary manner.

It is a further object of the present invention to provide a versatile pickup device which can be handled without contacting any element which has itself contacted animal droppings.

It is yet another object of the present invention to permit disposal of securely wrapped feces without requiring contact with any element which contacts that feces.

It is yet a further object of the present invention to provide a lightweight and easily carried versatile pickup device.

It is still another object of the present invention to provide a versatile pickup device which is sanitary for storage.

It is still a further object of the present invention to provide a versatile pickup device which requires only one hand to operate.

It is another object of the present invention to provide a versatile pickup device which can be used to clear a large area of animal droppings.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
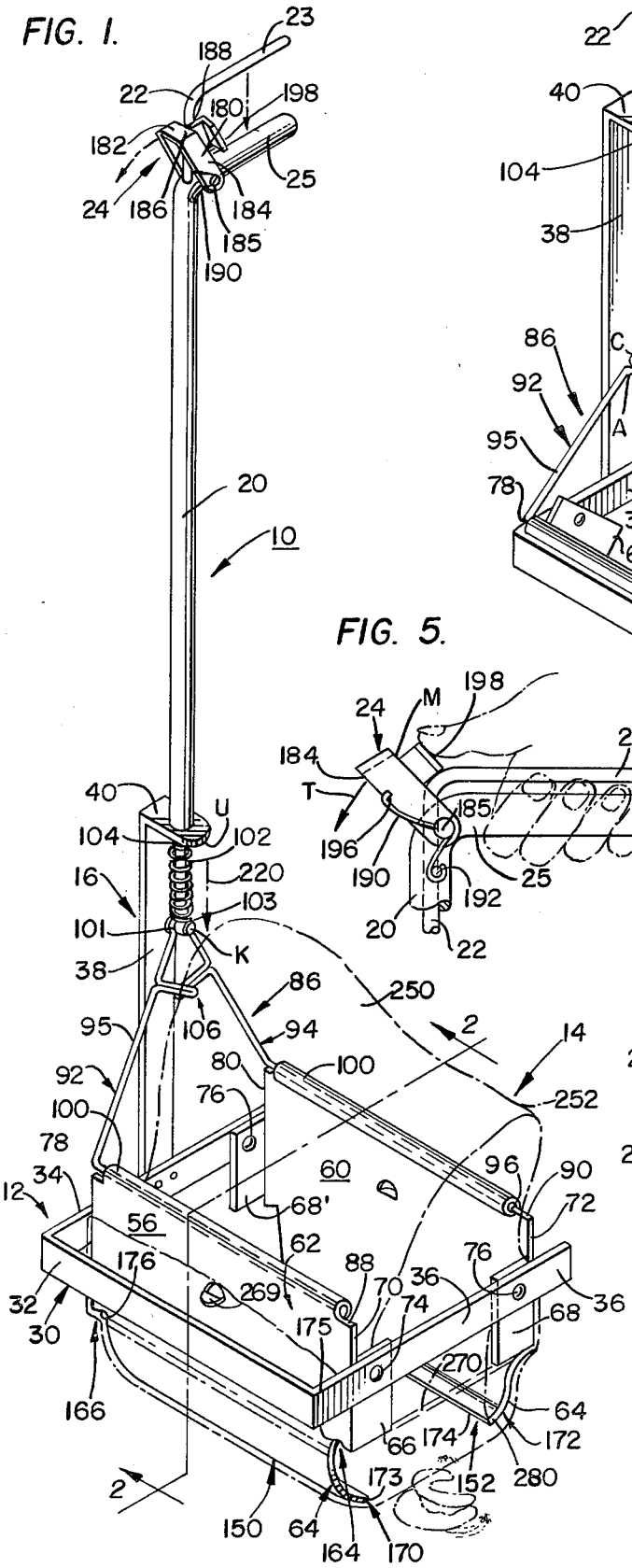
FIG. 1 is a perspective view of the device embodying the teachings of the present invention.

Shown in FIG. 1 is a device for picking up animal droppings or the like. For the sake of convenience, directions and orientations, such as top, bottom, and the like will be taken with respect to the FIG. 1 orientation of the device. However, no limitations are intended by this nomenclature. The device is generally denoted by the numeral 10 and includes an integral frame member 12 supporting a pickup means 14 and having a bracket 16. A tubular sleeve 20 is endwise mounted at a lower end thereof on the bracket and an operating rod 22 having a control handle 23 on an upper end thereof is slidably received in the tubular sleeve. A trigger-release control means 24 is mounted on the tubular sleeve. The top of the tubular sleeve is bent over at a 90° angle to form a support handle 25.

Figure 2:
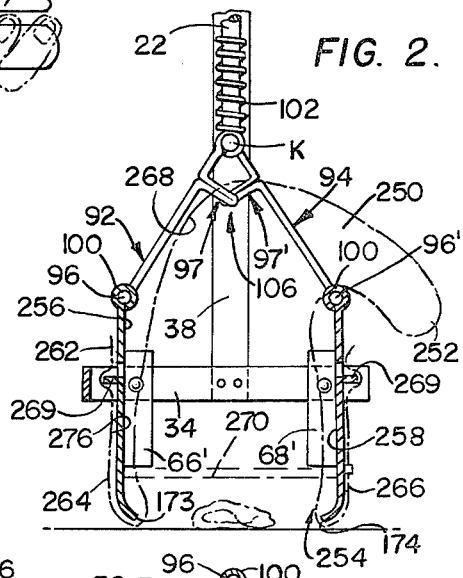
FIG. 2 is an elevation view of the device positioned for a pickup.

As shown in FIGS. 1 and 2, the frame 12 includes a brace 30 which is U-shaped having longitudinal sides, such as lateral side 32, and transverse sides, such as first end 34 and second end 36. The bracket 16 includes an upstanding arm 38 integrally mounted at a lower end thereof on the brace end 34 and having on the upper end thereof a mounting arm 40 extending inwardly and longitudinally of the frame. The arm 38 is preferably located medially of the end 34.

The pickup means 14 includes a pair of cooperating elongate blades 56 and 60, each having a planar central portion such as portion 62 of blade 56, and an arcuate lower portion, such as portion 64 of blade 56 which curve inwardly of the bracket 14 as shown in FIG. 1. The blades are shown in FIG. 1 in the cocked or reposed position wherein they are facially opposed and may have the central portions thereof in spaced parallelism. The blades are elongate and are co-extensive, and each has mounting ears 66 and 68 integrally attached thereto along first end edges 70 and 72 thereof. The ears extend inwardly of the pickup means toward each other to be perpendicular to the planes of the blade central portions.

Figure 3:
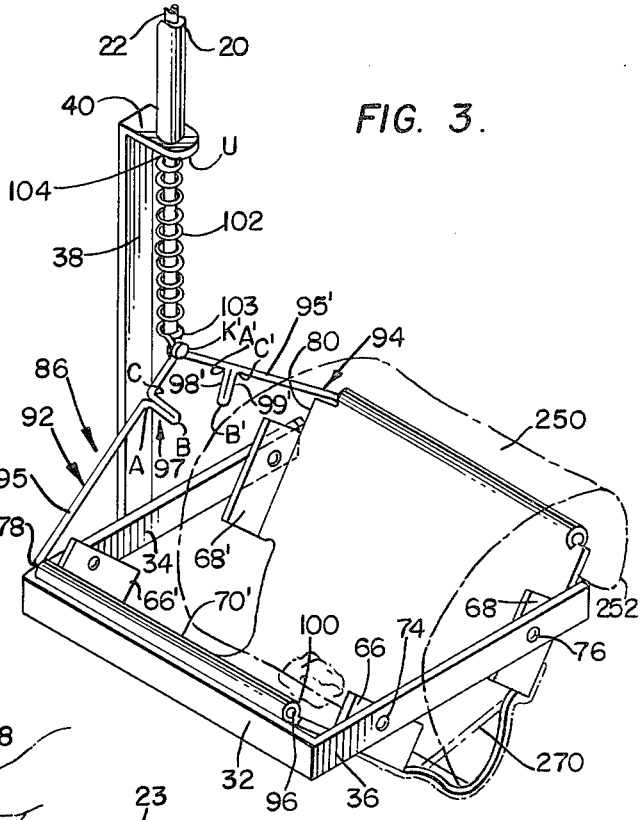
FIG. 3 is a perspective view of the device after pickup.

Fastener means 74 and 76 pivotally attach the ears 66 and 68, respectively, to the frame end 36, thereby pivotally and tiltably attaching the blades to the frame. The other end edges 78 and 80 of the blades are also pivotally connected to the frame end 34 by ears 66' and 68' (FIG. 3). The fasteners are oriented to be medial of the blades along the transverse direction thereof.

Figure 9:
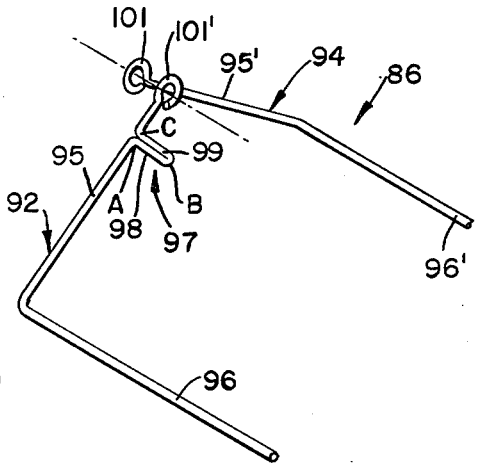
FIG. 9 is a perspective view of hinges used in the device embodying the teachings of the present invention.

A wire hinge 86 is mounted on top of the blades at top side edges 88 and 90 thereof and includes elongate hinge arms 92 and 94 which are located adjacent the bracket 38 to be out of the way to enable the device 10 to be loaded from either the top or the bottom thereof, as will be evident from the ensuing disclosure. The hinge thus provides versatility to the device 10 to a degree not present in heretofore known devices. The hinge permits the device to be used as a pickup device to clear large or small areas as well as to catch debris prior to that debris reaching the ground. The hinge arms are best shown in FIG. 9.

Hinge 92 includes a body section 95 and a blade contacting pintle section 96. A hinge clip defining projection 97 is located near the top of the body section and extends inwardly of the bracket toward the longitudinal centerline thereof. The projection is formed by a succession of bends in the body including a first 90° bend A, a 180° bend B and a second 90° bend C. The hinge clip is useful for holding over-sized wrappers as will be apparent from the ensuing discussion. Portions 98 and 99 are formed by the bends to define the projection. Hinge-like pintle receiving member 100 is formed on the blade 56 on the top side edge thereof to pivotably and rotatably receive the pintle section 96 of the hinge 92. A knob K is formed on the lower terminal end of the operating rod 22 and the topmost ends of the hinges include hooks 101 which are connected to that operating rod knob for movement therewith, as shown in FIG. 1. A tension spring 102 has a lower end 103 resting on the knob K and an upper end 104 engaging the lower surface U of the mounting arm 40 to control movement of the hinge arms and the operating rod as will be discussed hereinafter.

The hinge arm 94 is identical to the hinge arm 92, and therefore will not be further described. Elements on the hinge arm 94 which are similar to elements on arm 92 are denoted by a prime notation. Thus, hinge clip defining projections 97 and 97′ define a hinge clip 106, and the topmost ends of the hinge arms are each connected to the knob K to cooperate and to operate the blades 56 and 60 in a manner to be discussed below.

Thus, as shown in FIGS. 1 and 3, the hinge arms each have an L shape defined by the body section and the pintle section which intersect to form an essentially right angle located in the plane of the blade end edges 78 and 80. The body sections of the hinge arms are therefore essentially coplanar with those blade end edges 78 and 80. The hinge clip forming projections are also essentially coplanar with the blade end edges 78 and 80 as shown in FIG. 1.

The hinge arms thus depend downwardly and outwardly from the knob K and the blades are therefore cantileveredly connected to the frame. The operating arm fits slidably through the tubular sleeve 20 and downward movement of the operating arm forces the hinge arms outwardly of each other, thereby forcing the blade top sides 88 and 90 outwardly away from each other. The pivotal connection of the blades on the frame thus causes the blades to tilt with respect to each other so that lower side edges 150 and 152 move arcuately toward each other so that the blades execute a pincer-like action.

The arcuate lower portions 64 are each offset from the end edges of the blades 56 and 60 to define notches such as notches 164 and 166 of blade 56.

Figure 6:
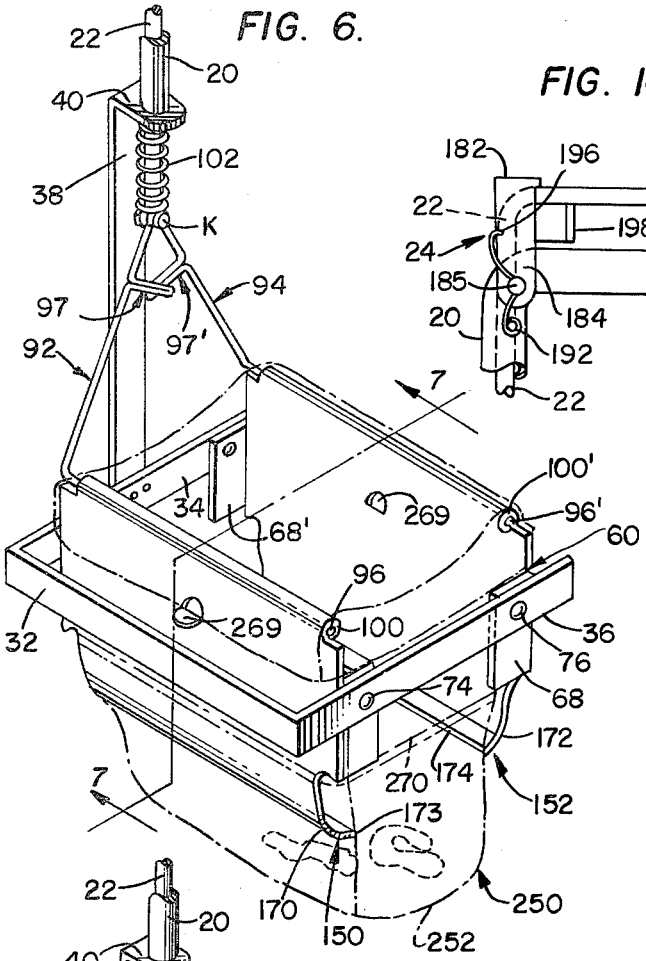
FIG. 6 is a perspective view showing an alternative method of using the device embodying the teachings of the present invention.

The bottom edge sections have end edges 170 and 172 which, as indicated by the shading in FIGS. 1 and 6, are rounded in the plane of the blades to extend transversely of the bottom sections. The bottom edge sections are thus curved in two planes. The bottom edge sections also have side edges 173 and 174 which are slanted and presented toward each other to flushly engage each other in the FIG. 3 closed configuration. The notches 164 and 166 are arcuate as shown in FIG. 1 to have upper sections 175 and 176, respectively. The purpose of the notches and the notch upper sections will be discussed below.

Figure 5:
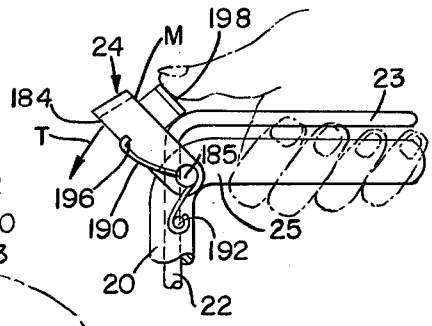
FIG. 5 is an elevation view showing the release and operating mechanisms of the device embodying the teachings of the present invention.

As best shown in FIG. 1, the control means 24 includes a yoke-like latch 180 pivotably mounted on top of sleeve 20 and includes a web section 182 and a pair of legs 184 each attached at one end to the web and at the other end to the sleeve by a pin 185. A notch engaging lip 186 is defined on the web to engage a corresponding notch 188 defined in the operating rod to prevent movement of that rod by engagement with the notch 186. A spring 190 is shown in FIG. 5 and has one end attached to a pin 192 on the tubular member 20 and the other end engaged with the yoke member to resist movement of that yoke member which is forward of the rod in the direction indicated by the arrow T in FIG. 5. The spring loops over the pin 185 on the yoke as a pivot point, and has an end 196 engaging the yoke. A side flange 198 is formed on one of the yoke legs for gripping the latch 180 to manually move same. The latch acts as a trigger release to release the operating arm as will be discussed below to allow the blades to operate and execute pickup movement, and the latch 180 is released from engagement by forcing the web section 182 in a counterclockwise direction with respect to the sleeve 20 against the yielding resistance of the spring 190 as shown in FIG. 5 by the arrow T.

The spring 102 is biased to apply a continuous upwardly directed force to the rod when the plates are in the FIG. 3 closed position, and thus bias same away from the bracket mounting arm 40 in the opposite direction of arrow 220 in FIG. 1 which indicates the plate closing direction. The spring 102 therefore biases the operating rod toward a position wherein the blades 56 and 60 are in the FIGS. 1 and 2 orientation. The engagement between the trigger mechanism lip 186 and the operating rod notch 188 prevents movement of the rod into the FIGS. 3 and 4 orientation, and the spring 190 maintains the latch in the detaining position to maintain the plates open.

The device in the cocked mode is shown in FIG. 1 and in the released, or pickup, mode in FIG. 3. When the trigger is actuated and the rod 22 is released, the spring 102 offers some resistance to movement of the operating rod downwardly with respect to bracket arm 40. However, the hand-squeezing of the handle overcomes the resistance of the spring. Downward movement of the operating rod is effected by squeezing the handle of the device, thereby forcing the hinge downwardly causing arms 92 and 94 to move outwardly away from each other at the lower ends thereof, and the tops 88 and 90 of the blades to move away from each other. The pivotal connection of the blades to the frame 12 causes those blades to tilt with respect to each other into the closed orientation shown in FIG. 3 with the lower blade edges 173 and 174 in contact with each other, or at least to be in close proximity with each other.

As best shown in FIGS. 1 and 2, a sanitary, flexible wrapper or holding means 250 is releasably positioned within the pickup means 14 for use in holding, transporting and disposing of animal waste, or the like. The wrapper has a bottom 252 and a mouth section 254 and is oriented in the mouth-down orientation within the pickup means 14 and covers the inner surfaces 256 and 258 of the blades to prevent contact between those blades and the animal feces in order to maintain the device in a sanitary state.

The wrapper has a lip or marginal edge 262 which surrounds the mouth section thereof and which is folded back over the lower edges of the blades to form cuffs 264 and 266. The folded position of the wrapper orients the inner surface 268 thereof inwardly between the blades and outwardly on the outside thereof.

After the device has been actuated, the spring 102 assists in re-opening the blades. When the plates are open, in the FIG. 1 or 2 orientation, the spring is at rest.

The wrapper can be of any of several types of bags used in this art, such as plastic, cloth, or the like, and has compliant, impervious walls. The downwardly opening orientation of the wrapper permits the feces to be scooped into that wrapper when the blades move into the FIG. 3 closed orientation. Prongs 269 are located on the blades to help retain the wrapper in position on the device.

An elastomeric-like flexible retainer, such as rubber band 270, may be positioned to surround the blades adjacent the notches 164, 166. The rubber band is stretched to be taut on the blades. The curvature of the blade ends 170 and 172 can be selected so that the band 270 can easily move off of the blades when desired. The dimensions, curvature and shapes of the arcuate lower portions can be selected so that the band 270 remains seated about the blades when the device is in the cocked orientation. It is noted that the notch-detent elements of the trigger mechanism prevents the band 270 from pulling the blades together.

When the pickup blades move into the closed orientation, the lower edges 170 and 172 move toward each other and upward toward the frame 12 in an arc. The band 270 is stretched tight enough to remain positioned about the blades during the initial phase of a blade closing movement. Due to the inward movement of the blades, the band 270 is forced against upper sections 175 and 176 of the notches 64 and slides onto the arcuate portions 64. The notch upper sections are immobile with respect to the frame, and hence the blade lower edges move out of the band as the blades continue to move with respect to the frame while the band is abuttingly held in position by the notch upper sections.

As shown in FIG. 2, the band 270 is located inside the cuffs 264 and 266 and hence adjacent the outer surface 276 of the wrapper. As the blades close, the wrapper mouth is closed, and the band 270 moves off of the blades. Band size and elasticity is selected so that the band closes the wrapper when that band moves off of the blades, and may even be pulled slightly outward of the blades during the closing process. The action of the rubber band upon contraction closes the mouth of the wrapper and also assists in scooping the feces throughout the peripheral area of the mouth of the wrapper upon closing. The length of cuffs 264 and 266, the flexibility of the wrapper, and the like, are selected so that the wrapper is freed from the blades and the band is selected to securely close the wrapper and maintain the wrapper closed once the device is actuated.

By positioning the wrapper to have cuffs, the blades are covered and never contact the ground or feces at any time. Thus, no element of the device ever contacts the feces, and the user never is required to contact any element that had such contact. The band pulls the wrapper down when the device is triggered, thus pulling that wrapper off of the blades and freeing same.

Figure 10:
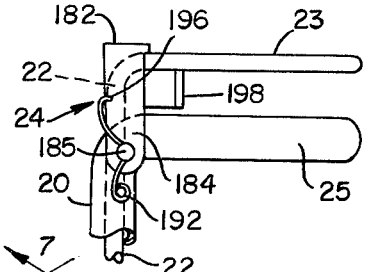
FIG. 10 is an elevation of the handle of the device.

One of the several modes of operation of the device is shown in FIGS. 1–3. In the FIGS. 1–3 mode of operation, the device is cocked when the blades are set into the orientation shown in FIGS. 1 and 2, with the clip 106 capturing the wrapper, and the trigger automatically locks into a detaining position due to the action of spring 190 with the lip 186 seated in a notch 188. Alternatively, the web of the trigger yoke can be locked over the handle as shown in FIG. 10 to lock the operating rod in the cocked position. As shown in FIGS. 1 and 2, the band 270 is wrapped around the blades adjacent the notches 164 of both blades, and the wrapper is oriented in position with the pickup means 14 as shown in FIGS. 1 and 2. The mouth of the wrapper is folded back over both blades, and in the preferred embodiment, the cuff formed is approximately 2 inches long. The folded-over mouth of the wrapper should pass the stretched band at notches 164. The bottom of the wrapper is left free and pushed back toward the hinge 86. As above discussed, the lower end edges 170 and 172 of the blades can be curved longitudinally of the blade and bracket to further assist in the movement of the band 270 off of the blades. The hinge clips are closed in the cocked position of the device to capture the wrapper therebetween and thus assist in holding the wrapper in the proper position. When the device is activated, the hinge clips move apart and thus release the wrapper as shown in FIG. 3.

When both the band and the wrapper are properly placed, the blades can be opened wider by pulling the rod out farther and allowing the trigger lip to move into another lower notch which can also be defined on the operating rod. Opening the blades wider spreads the mouth of the wrapper wider and holds that wrapper in a tight fitting position.

The cocked device is oriented above the feces to be picked up with the blades straddling that feces to orient the wrapper in a pickup position, as shown in FIG. 1. The device is then held in a vertical orientation with respect to the ground and over the feces and then a lowering movement moves that unit until the blade lowermost edges contact the ground adjacent the feces, as shown in FIG. 2. The trigger is then released. If the feces is spread out, the unit may be used as a shovel to push the feces together to fit within the open mouth of the unit. The trigger is released by pressing on release means M as indicated in FIG. 5. After release of the trigger, preferably with the thumb, the control handle is slowly squeezed toward the support handle 25. The squeezing action overcomes the force of the spring and rod 22 is moved downwardly, thereby forcing the blades into the closed position shown in FIG. 3. The clip 106 releases the wrapper as the blades move into the FIG. 3 orientation. The blades scrape along the ground and force the feces into the wrapper as shown in FIG. 3, the band abuts the upper sections of the notches and the blades move out from within that band. The band snaps over the wrapper and closes the mouth of the wrapper with the feces contained within that wrapper. The device can be locked in a closed orientation by defining further notches higher up on the operating rod and permitting the trigger lip to engage those further notches.

The device is left closed until a suitable disposal unit is obtained, whereupon the device is actuated by unlocking the trigger by manipulating the release M if the trigger has been locked, pulling the rod 22 upwards, as by grasping the handle 23, until the trigger detains the rod by the trigger lip 186 engaging a suitable notch, such as notch 188. The upward movement of the rod is assisted by the bias of the spring 102 and pulls the hinge arms upwardly and hence toward each other to thereby pull the tops of the blades toward each other, and the blades are thus opened. Thus, after pickup, without use of the just-mentioned detaining notches, the handle will come back up again under the force of the spring 102. The wrapper will not be automatically recaptured by the hinge clip, and as the wrapper is not attached to the device, that wrapper is released for deposit into a suitable disposal unit. Complete pickup and wrapped disposal is thus effected without ever requiring contact with either the feces or any element contacting the feces. The pickup and wrapped disposal is, therefore, sanitary and expeditious.

Figure 4:
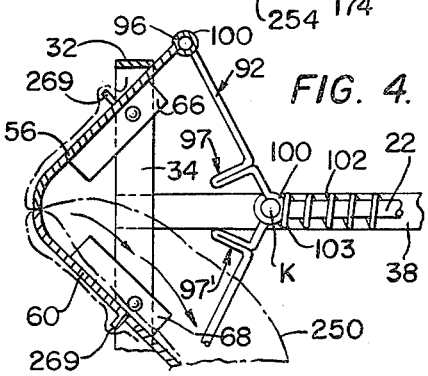
FIG. 4 is a view showing an alternative method of using the device embodying the teachings of the present invention.

Another of the methods of operating the pickup device does not include a band 270. The last-mentioned method is useful and practical when walking more than one dog or cleaning up an area, kennel or any special situation. In this alternative method, the flexible wrapper is placed as before, and the cuff thereof is caught on the prongs 269 for retention in the device. The last-mentioned method is similar to the first-mentioned method except that, after each pickup, the device is tilted as indicated in FIG. 4 to move the debris into the bottom of the wrapper. In the last-mentioned method, the bag is oriented to hang over the side or back of the device as illustrated in FIG. 3. For disposal, the wrapper is removed from the prongs, and the blades opened to thereby release that wrapper from the device. The wrapper can initially be set in the device 10 as illustrated in FIG. 1, and then will assume the FIG. 3 orientation after a pickup and tilting operation as indicated in FIG. 4.

Alternatively, after pickup, and blade closure into the FIG. 4 orientation, the debris is moved into the closed bottom of the wrapper as before. However, the wrapper need not be attached to the prongs as the closed blades can be used to maintain the wrapper in position within the device. To dispose of the filled wrapper, the user need only position the device over a disposal means and open the blades thereby permitting the wrapper to drop free of the device. In this manner the user never touches the wrapper after placing that wrapper in the device.

It is noted that even using the prongs, only a very small portion of the wrapper need be touched to free the wrapper from the prongs, and the sanitary nature of the device remains essentially intact.

Figure 7:
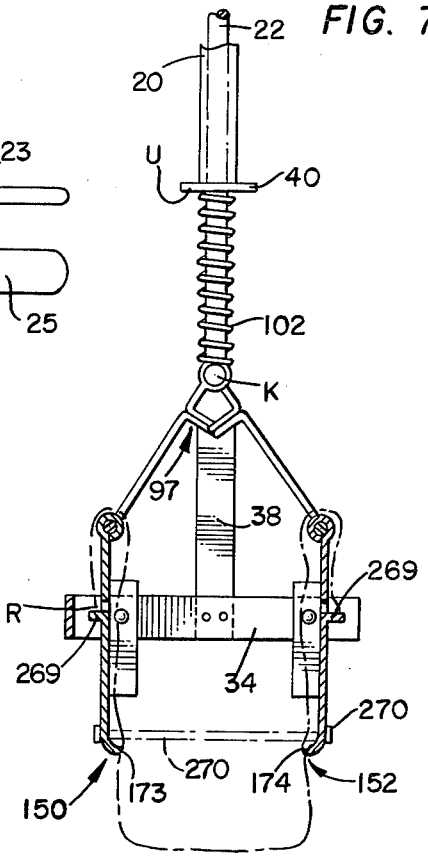
FIG. 7 is an end elevation view of the device shown in FIG. 6.
Figure 8:
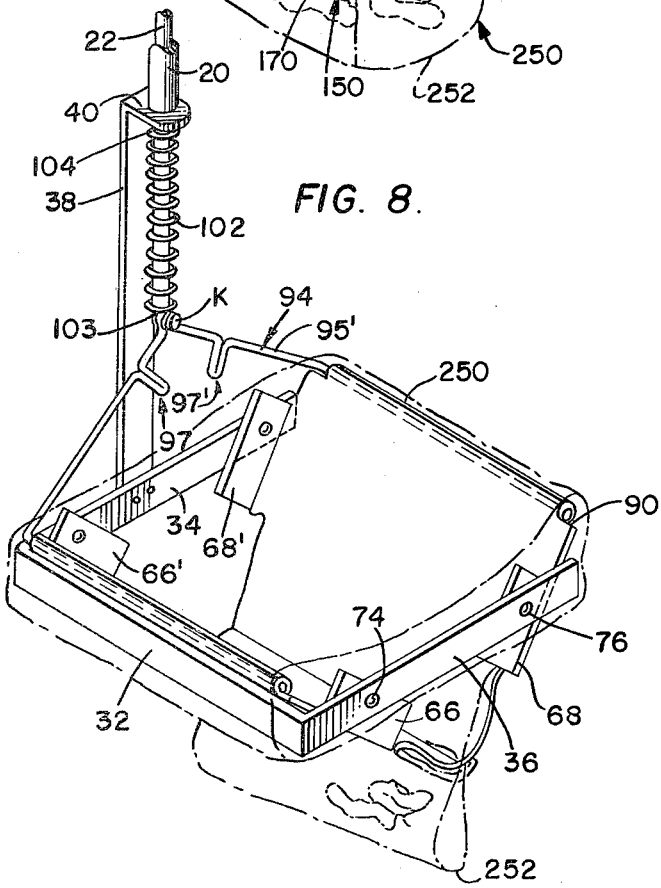
FIG. 8 is a perspective view of the device operated according to the method illustrated in FIG. 6.

A further method of operating the pickup device 10 is illustrated in FIGS. 6–8. In this further method, the device is used as a receptacle for catching animal droppings at time of defecation. This further method has many applications, especially in special training situations. In this further method, the wrapper is placed in the device as illustrated in FIG. 8, with the mouth thereof opening upwardly (as opposed to downwardly in the other methods), the bottom of the wrapper hanging below the pickup plates and with the blades in the closed position. The wrapper is folded over the sides and front of the plates. The back section of the wrapper near the hinge is retained upward. The droppings are then caught with the plates in the FIG. 8 closed position. After catching the droppings, the plates are opened, as will be discussed below, to move the caught droppings into the wrapper for storage and later disposal.

Each time the device is used as a receptacle to catch animal droppings, the plates are simply opened with the bottom of the wrapper supported on the ground as illustrated in FIG. 6. The blades may then be closed, and the device is again ready to be used as a receptacle, or to carry the debris to a disposal area. The hinge 86 is out of the way as not to interfere with movement of debris into the wrapper. As shown in FIG. 7, the wrapper is located to have the rim R thereof positioned above the prongs. Thus, for disposal, the user need only locate the filled wrapper above a disposal means, and open the blades to drop the filled wrapper out of the device into that disposal means. Thus, a user is not required to touch the wrapper after positioning that wrapper in the device, and the sanitary nature of the device is retained.

If the debris is missed for some reason, the device can be operated according to the above-described methods to remove the debris.

Thus, the device 10 is extremely versatile and can be operated in a variety of ways, to provide the most convenient method of collecting debris, especially animal droppings, for any given situation.

The unit can be produced in a variety of sizes to accommodate animals of various sizes, such as, for example, small, medium and large. The wrapper and band can be produced to fit the various unit sizes.

As this invention may be embodied in several forms without departing from the spirit or essential characteristics thereof, the present embodiment is, therefore, illustrative and not restrictive, since the scope of the invention is defined by the appended claims rather than the description preceding them, and all changes that fall within the metes and bounds of the claims or that form their functional as well as conjointly cooperative equivalents are, therefore, intended to be embraced by those claims.

I claim:

1. A portable device for picking up animal droppings and collecting those droppings into a wrapper comprising:

a frame;

a pair of blades pivotally mounted on said frame and each having side edges, an upper edge and a bottom edge, said blade upper edges defining a top access area and said blade lower edges defining a bottom access area;

a blade operating hinge having a pair of arms each having an upper end and a lower end with said lower ends each being hingeably connected to a blade upper edge, said hinge being located to one side of said blades to provide free access to the area between said blades via either said top or the bottom access areas;

an operating rod hingeably connected to said hinge upper ends and being movably connected to said frame so that movement of said rod with respect to said frame causes said blade upper edges to move via the movement of said hinge, said blades being mounted on said frame to be caused to tilt toward and away from each other by the movement of said upper edges; and means for closing the wrapper.

2. The device of claim 1, wherein said means for closing the wrapper includes a flexible band positioned to encircle said blades, said flexible band being located adjacent said blade bottom edges to be moved off said blades when said blades are tilted to move said bottom edges toward each other to close the wrapper positioned between said blades.

3. The device of claim 2, wherein said blades each has notches defined in the side edges thereof adjacent said bottom edges.

4. The device of claim 3, wherein said blades each has an arcuate corner adjacent said bottom edge and said notches with said band being positioned on said blade bottom edge adjacent said notches.

5. The device of claim 2, wherein the wrapper is folded over said blade bottom edges and said band to prevent animal droppings from contacting said blades.

6. The device of claim 2, wherein said band comprises an elastomeric material.

7. The device of claim 1, further including a tubular sleeve mounted on said frame, said operating rod being received within said sleeve to be longitudinally slidable therewith and having a top portion extending out of said sleeve.

8. The device of claim 7 wherein said operating rod has a notch defined therein on said top portion, and further including a control means mounted on said sleeve which includes a detent lip for engaging said notch, said detent lip engaging said notch to hold said operating rod in position, a first spring on said control means to force said detent lip into engagement with said notch, and a second spring on said operating rod biasing said rod upwardly when said blades are tilted toward each other.

9. The device of claim 1, further including a hinge clip on said hinge to hold the wrapper between said blades, said clip releasing the wrapper when said hinge arms move apart.

10. The device of claim 1, wherein the wrapper has an open mouth and is positioned to have the mouth open upwardly to catch animal droppings in the wrapper prior to those droppings contacting the ground.

11. The device of claim 1, wherein the lower portion of each of said blades is arcuate and said lower portions curve toward each other.

12. The device of claim 1, wherein said blades each have end edges which are vertically oriented, each hinge arm including a lower section pivotably attached to an upper edge of one of said blades, a body section attached to said lower section to form an L shape, with said body section extending upwardly and being located essentially coplanar with the end edge of the blade to which said each hinge arm is attached.

* * * * *